US009934720B2

(12) United States Patent
Lee et al.

(10) Patent No.: US 9,934,720 B2
(45) Date of Patent: Apr. 3, 2018

(54) VOLTAGE COMPENSATION TYPE PIXEL CIRCUIT AND METHOD FOR DRIVING THE SAME

(71) Applicant: Foundation of Soongsil University-Industry Cooperation, Seoul (KR)

(72) Inventors: Hojin Lee, Seoul (KR); Yongchan Kim, Seoul (KR); Yeonkyung Kim, Seoul (KR)

(73) Assignee: FOUNDATION OF SOONGSIL UNIVERSITY-INDUSTRY COOPERATION, Seoul (KR)

( * ) Notice: Subject to any disclaimer, the term of this patent is extended or adjusted under 35 U.S.C. 154(b) by 168 days.

(21) Appl. No.: 14/894,447

(22) PCT Filed: May 31, 2013

(86) PCT No.: PCT/KR2013/004847
§ 371 (c)(1),
(2) Date: Nov. 27, 2015

(87) PCT Pub. No.: WO2014/193015
PCT Pub. Date: Dec. 4, 2014

(65) Prior Publication Data

US 2016/0117981 A1 Apr. 28, 2016

(30) Foreign Application Priority Data

May 29, 2013 (KR) ..... 10-2013-0061242

(51) Int. Cl.
*G09G 3/32* (2016.01)
*G09G 3/3225* (2016.01)
(Continued)

(52) U.S. Cl.
CPC ..... *G09G 3/3225* (2013.01); *G09G 3/2096* (2013.01); *G09G 3/3233* (2013.01);
(Continued)

(58) Field of Classification Search
CPC .. G09G 3/3208; G09G 3/3233; G09G 3/3241; G09G 3/3225
(Continued)

(56) References Cited

U.S. PATENT DOCUMENTS

2009/0184902 A1* 7/2009 Tomida ..... G09G 3/3233 345/77
2014/0168180 A1* 6/2014 Kim ..... H05B 33/0896 345/205
(Continued)

FOREIGN PATENT DOCUMENTS

KR 10-2006-0090393 A 8/2006
KR 10-2008-0022718 A 3/2008
(Continued)

*Primary Examiner* — Yuzhen Shen
(74) *Attorney, Agent, or Firm* — Novick, Kim & Lee, PLLC; Sang Ho Lee

(57) ABSTRACT

A voltage compensation pixel circuit includes a driving transistor coupled to the light emitting element between a high potential power line and a low potential power line to drive the light emitting element in response to a predetermined voltage applied to a gate, switching transistor including a first switching transistor being switched in response to a voltage of a first gate signal, a second switching transistor and a third switching transistor being switched in response to a voltage of a third gate signal, and a fourth switching transistor being switched in response to a voltage of a second gate signal, a storage capacitor coupled between a first node and a second node, and a setup transistor coupled between the light emitting element and the driving transistor and operated by the driving transistor. The first node is coupled
(Continued)

to the driving transistor. The second node is coupled between the second switching transistor and the fourth switching transistor.

10 Claims, 7 Drawing Sheets

(51) Int. Cl.
*G09G 3/3233* (2016.01)
*G09G 3/36* (2006.01)
*G09G 3/20* (2006.01)

(52) U.S. Cl.
CPC ... *G09G 3/3659* (2013.01); *G09G 2300/0417* (2013.01); *G09G 2310/0251* (2013.01); *G09G 2310/0262* (2013.01); *G09G 2320/043* (2013.01); *G09G 2330/028* (2013.01)

(58) Field of Classification Search
USPC ..... 345/76, 82
See application file for complete search history.

(56) References Cited

U.S. PATENT DOCUMENTS

2014/0326969 A1* 11/2014 Kim ..... H01L 27/3262 257/40
2016/0240134 A1* 8/2016 Yang ..... G09G 3/3233

FOREIGN PATENT DOCUMENTS

KR 10-2008-0082464 A 9/2008
KR 10-1074811 B1 10/2011
KR 10-2011-0127006 A 11/2011
KR 10-1113430 B1 3/2012
KR 10-2013-0050491 A 5/2013

* cited by examiner

VOLTAGE COMPENSATION TYPE PIXEL CIRCUIT AND METHOD FOR DRIVING THE SAME

TECHNICAL FIELD

The present disclosure relates to a voltage compensation pixel circuit used in an active matrix organic light emitting diode display device and a method of driving the same.

BACKGROUND ART

An active matrix organic light emitting diode (hereinafter, referred to as 'AMOLED') display device is a spontaneous emission unit configured to illuminate an organic light emitting layer by recombination of electrons and holes, which has high luminance and low driving voltage, and is capable of being ultra-thin, and thus, is expected to be a next generation display device.

Each of the plurality of pixels forming the AMOLED display device includes a light emitting unit having an organic light emitting layer interposed between an anode and a cathode and a pixel circuit configured to independently drive the light emitting unit. The pixel circuit is classified into a voltage driving compensation circuit and a current driving compensation circuit. The voltage driving compensation circuit is a type for applying data voltage to the pixel circuit, and the current driving compensation circuit is a type for applying data current to the pixel circuit. The voltage driving compensation circuit and the current driving compensation circuit have commonality in storing data voltage in a storage capacitor connected to a gate of a driving unit as a result of operation processes thereof.

Meanwhile, in order to apply data voltage to each of the pixels in the voltage driving compensation circuit, first, a parasitic capacitor of a line is required to be charged and discharged. The voltage driving type is easier to charge/discharge than the current driving type, and thus, has a fast pixel operating speed, and is easy to connect with signals of a display driving circuit. All of the driving voltage pixel compensation circuits have a period of self-compensating a critical voltage of the driving unit. In a conventional critical voltage compensation method, the critical voltage of the driving unit is detected and charged in the storage capacitor, and is offset when an OLED current flows, and thus, an effect thereof is removed. However, since a difference of electron mobility generated in a process of switching thin film transistor (hereinafter, referred to as 'TFT') units is not stored or compensated by the circuit, the difference of the electron mobility generated in the process of the TFT unit is not theoretically compensated. Also, in the voltage driving compensation circuit, additional signal lines and TFT units configured to compensate for a change of the critical voltage share a large space of an entire pixel area, and thus, the opening ratio is greatly decreased.

The current driving compensation circuit is advantageous in receiving a current from a data driving IC and storing the current in a scan period, and then, the current flows in an OLED light emitting period. The current driving compensation circuit is advantageous in compensating for mobility as well as the difference of the critical voltage. Also, since the current driving compensation circuit is not affected by a voltage drop phenomenon of a supplied voltage, the current driving compensation circuit has a structure for ideally and stably supplying an OLED current. However, since the storage capacitor in the circuit is required to be charged by the data current, a charging time requires long time in a low data current level by the parasitic capacitor portion of the data line, and a long time is required to drive each pixel. In particular, the above property has a problem of increasing a time for charging a pixel in a high resolution and large sized panel. In order to solve the above problem, a pixel circuit using a current mirror structure is developed and a pixel charging time is minimized, but an error is generated when electric characteristics of a mirror unit are different from that of the driving unit. Also, since currently commercialized driving ICs use the voltage driving type, an additional cost is required to manufacture an additional driving IC.

Meanwhile, among element unit technologies of the pixel circuit included in the display, an amorphous silicon TFT has characteristics of uniformly maintaining electron mobility even in a large sized substrate and in established manufacturing technology, and is first considered in the development of a large sized AMOLED display technology. However, the amorphous silicon TFT has poor characteristics in electric stability due to unique characteristics of an amorphous silicon layer. The most important problem caused by the unstability of the amorphous silicon TFT is a change of the critical voltage caused by a stress from a continuous gate bias.

SUMMARY OF INVENTION

Technical Problem

The present disclosure is directed to providing a voltage compensation pixel circuit capable of adjusting a flow of a voltage in an organic light emitting diode (OLED) pixel circuit applied by an active matrix and compensating for a change of a critical voltage caused by a continuous gate bias to a driving TFT, and a method of driving the same.

Technical Solution

One aspect of the present invention provides a voltage compensation pixel circuit of an organic light emitting display device, which is capable of driving a light emitting unit. The voltage compensation pixel circuit includes a driving thin film transistor (TFT) connected to the light emitting unit provided between a high potential power line and a low potential power line, and configured to drive the light emitting unit based on a predetermined voltage applied to a gate; switching TFTs including a first switching TFT switched by an on or off voltage of a first gate signal, a fourth switching TFT switched by an on or off voltage of a second gate signal, and a second switching TFT and a third switching TFT switched by an on or off voltage of a third gate signal; a storage capacitor of which one end is connected to the driving TFT to form a first node, and the other end is connected to a contact point between the second switching TFT and the fourth switching TFT to form a second node, wherein the storage capacitor transmits a charged voltage to the driving TFT; and a setup TFT installed at a contact point between the light emitting unit and the driving TFT and operated by switching of the driving TFT.

The first switching TFT, the second switching TFT, and the third switching TFT may be turned on by on voltages of the first gate signal and the third gate signal, and a predetermined voltage may be charged in the storage capacitor.

When a predetermined voltage is charged in the storage capacitor, a voltage may be applied to a gate of the driving TFT connected to the one end of the storage capacitor, a current flows from the high potential power line to the low potential power line, and the light emitting unit may be operated by the current.

The first switching TFT may be turned off based on an off voltage of the first gate signal, and a voltage charged in the storage capacitor may be discharged through the second switching TFT, the third switching TFT, and the setup TFT.

A compensation voltage formed on the first node by discharging the voltage charged in the storage capacitor may be formed by summing a critical voltage of the driving TFT, a critical voltage of the setup TFT, and an electron mobility compensation voltage of the driving TFT.

The first switching TFT, the second switching TFT, and the third switching TFT may be turned off, the fourth switching TFT may be turned on, and a data signal may be transmitted to the driving TFT.

When the first switching TFT, the second switching TFT, and the third switching TFT may be turned off, the fourth switching TFT may be turned on, and the data signal may be transmitted to the driving TFT, a voltage applied to the first node may be formed by summing a voltage applied by the data signal and a compensation voltage applied to the first node.

The voltage applied to the first node may be formed by summing the voltage applied by the data signal and the compensation voltage applied to the first node, and when the fourth switching TFT is turned off, a current flowing through the light emitting unit by a voltage stored in the storage capacitor may be determined by a voltage between a gate and a source of the driving TFT and a critical voltage of the driving TFT.

Another aspect of the present invention provides a method of driving a voltage compensation pixel circuit. The voltage compensation pixel circuit includes a light emitting unit, a driving TFT configured to drive the light emitting unit, a plurality of switching TFTs switched by an on or off signal of a gate signal, a storage capacitor connected to the driving TFT and configured to transmit a charged voltage to the driving TFT, and a setup TFT installed at a contact point between the light emitting unit and the driving TFT and operated by switching of the driving TFT. The method includes individually operating the plurality of switching TFTs based on the on or off voltage of the gate signal and charging a compensation voltage in the storage capacitor; and turning off all of the plurality of switching TFTs in order to compensate for a change of a critical voltage of the driving TFT, and flowing a current proportional to a voltage obtained by summation of a voltage of a data signal and an electron mobility compensation voltage of the driving TFT through the light emitting unit.

The individually operating the plurality of switching TFTs based on the on or off voltage of the gate signal and charging the compensation voltage in the storage capacitor may include turning on a first switching TFT, a second switching TFT, and a third switching TFT of the plurality of switching TSTs and charging a predetermined voltage in the storage capacitor.

The individually operating the plurality of switching TFTs based on the on or off voltage of the gate signal and charging the compensation voltage in the storage capacitor may include discharging the voltage charged in the storage capacitor may be discharged through the second switching TFT, the third switching TFT, and the setup TFT when the predetermined voltage is charged in the storage capacitor and the first switching TFT is turned off.

A compensation voltage formed by discharging the voltage charged in the storage capacitor through the second switching TFT, the third switching TF, and the setup TFT may be equal to a voltage obtained by summation of a critical voltage of the driving TFT, a critical voltage of the setup TFT, and an electron mobility compensation voltage of the driving TFT.

The method of driving the voltage compensation pixel circuit may further include turning off the first switching TFT, the second switching TFT, and the third switching TFT, turning on a fourth switching TFT, and summing the data signal with the compensation voltage for transmission to the driving TFT.

The method of driving the voltage compensation pixel circuit may further include summing the data signal with the compensation voltage for transmission to the driving TFT, turning off the fourth switching TFT, and operating the driving TFT by a voltage stored in the storage capacitor.

The operating the driving TFT by the voltage stored in the storage capacitor may include operating the driving TFT by a voltage obtained by summation of the voltage of the data signal and the electron mobility compensation voltage of the driving TFT.

Advantageous Effects of Invention

As described above, according to embodiments of the present invention, a difference of electron mobility which can affect a current flowing a light emitting unit can be compensated by an electron mobility compensation voltage of a driving TFT.

DETAILED DESCRIPTION OF EXEMPLARY EMBODIMENTS

Figure 1:
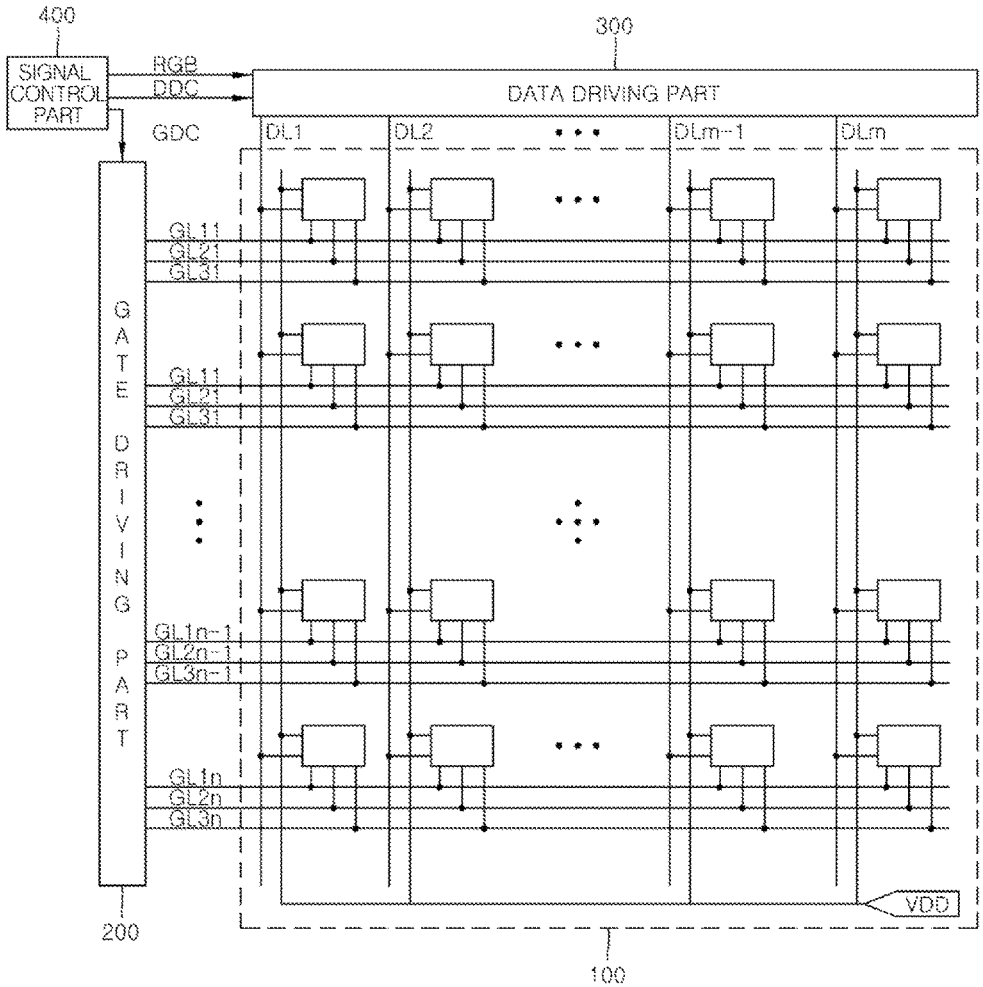
FIG. 1 is a block diagram briefly illustrating an organic light emitting display device including a voltage compensation pixel circuit according to one embodiment of the present invention.

Hereinafter, exemplary embodiments of the present invention will be described in detail with reference to the accompanying drawings. In numbering reference numerals to the structural parts of each drawing, like numerals may refer to like elements throughout the description of the figures although the reference numerals are displayed in different drawings.

FIG. 1 is a block diagram briefly illustrating an organic light emitting display device including a voltage compensation pixel circuit according to one embodiment of the present invention.

An organic light emitting display device may include a display plate 100, a gate driving part 200 connected to the display plate 100, a data driving part 300, and a signal control part 400 configured to control the above parts.

The display plate 100, when viewing an equivalent circuit, may be connected to a plurality of signal lines GL1*n* to GL3*n*, and DL1 to DLm, and may include a plurality of pixels arranged in a shape similar to a matrix shape.

The signal lines GL1*n* to GL3*n*, and DL1 to DLm may include a plurality of scan signal lines GL1*n* to GL3*n* configured to transmit scan signals and a plurality of data lines DL1 to DLm configured to transmit data signals.

Figure 2:
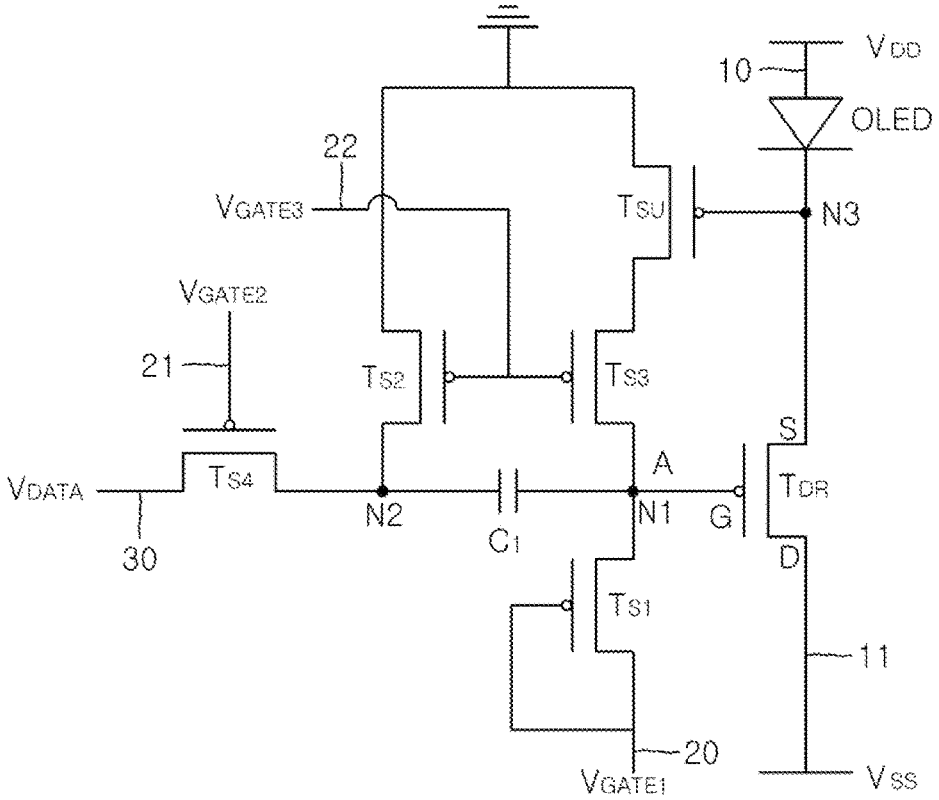
FIG. 2 is a circuit diagram illustrating a voltage compensation pixel circuit according to one embodiment of the present disclosure.

FIG. 2 is a circuit diagram illustrating a voltage compensation pixel circuit according to one embodiment of the present invention.

The voltage compensation pixel circuit independently operates a light emitting unit (OLED) and generates a luminance in response to a data voltage $V_{DATA}$, and may include six TFTs $T_{S1}$, $T_{S2}$, $T_{S3}$, $T_{S4}$, $T_{SU}$, and $T_{DR}$, and one storage capacitor $C_1$.

The light emitting unit OLED may be connected to a driving TFT $T_{DR}$ in series between a high potential power line 10 and a low potential power line 11. The light emitting unit OLED may include a cathode connected to the driving TFT $T_{DR}$, an anode connected to the high potential power line 10, and a light emitting layer interposed between the cathode and the anode. The light emitting layer may include an electron injection layer, an electron transport layer, an organic light emitting layer, a hole transport layer, and a hole injection layer which are sequentially stacked between the cathode and the anode. In the light emitting unit OLED, when a positive bias is applied between the anode and the cathode, electrons from the cathode pass through the electron injection layer and the electron transport layer and are supplied to the organic light emitting layer, and holes from the anode pass through the hole injection layer and the hole transport layer and are supplied to the organic light emitting layer. Thus, the supplied electrons and holes are recombined in the organic light emitting layer, and illuminate a fluorescent or phosphorescent material, and thus, a luminance proportional to a current density may be generated. Meanwhile, when a negative bias is applied to the light emitting unit OLED, the light emitting unit OLED may perform a function of a capacitor ($C_{OLED}$) configured to store charges.

The voltage compensation pixel circuit may include one driving TFT $T_{DR}$, one setup TFT $T_{SU}$, four switching TFTs $T_{S1}$, $T_{S2}$, $T_{S3}$, and $T_{S4}$, and one storage capacitor $C_1$ connected between the driving TFT $T_{DR}$ and the switching TFT $T_{S4}$.

The voltage compensation pixel circuit may include three gate lines 20, 21, and 22 configured to supply the gate signals, the high potential power line 10 supplying the high potential voltage $V_{DD}$, the low potential power line 11 supplying the low potential voltage $V_{SS}$ smaller than the high potential voltage $V_{DD}$, and a data line 30 supplying the data voltage.

In the driving TFT $T_{DR}$, a gate electrode is connected to a first node N1, a source electrode is connected to the cathode of the light emitting unit OLED, and a drain electrode is connected to the low potential power line 11. The driving TFT $T_{DR}$ adjusts a current supplied from the high potential power line 10 and passed through a third node N3 in response to a voltage supplied to the first node N1, and adjusts the light emitting unit OLED.

In the setup TFT $T_{SU}$, a gate electrode is connected to the third node N3, and a first electrode is connected to a ground potential, and a second electrode is connected to a first electrode of a third switching TFT $T_{S3}$. The setup TFT $T_{SU}$ is operated by a voltage generated at the third node N3 based on the operation of the driving TFT $T_{DR}$.

The four switching TFTs $T_{S1}$, $T_{S2}$, $T_{S3}$, and $T_{S4}$ may include the first switching TFT $T_{S1}$, the second switching TFT $T_{S2}$, the third switching TFT $T_{S3}$, and the fourth switching TFT $T_{S4}$.

The first switching TFT $T_{S1}$, has a gate electrode and a first electrode being connected to the first gate line 20 and a second electrode being connected to the first node N1 which is connected to the storage capacitor $C_1$ and the gate electrode of the driving TFT $T_{DR}$. The first electrode and the second electrode become a source electrode and a drain electrode based on a current direction.

The second switching TFT $T_{S2}$ has a gate electrode being connected to the third gate line 22, a first electrode being connected to the storage capacitor $C_1$ and the fourth switching TFT $T_{S4}$, and a second electrode being connected to the ground potential. The first electrode and the second electrode become a source electrode and a drain electrode based on a current direction.

The third switching TFT $T_{S3}$ has a gate electrode being connected to the third gate line 22 connected to the gate electrode of the second switching TFT $T_{S2}$, the first electrode being connected to the second electrode of the setup TFT $T_{SU}$, and a second electrode being connected to the first node N1 interposed between the storage capacitor $C_1$ and the driving TFT $T_{DR}$.

The fourth switching TFT $T_{S4}$ has a gate electrode being connected to the second gate line 21, a first electrode being connected to the data line 30, and a second electrode being connected to the first electrode of the second switching TFT $T_{S2}$ and the storage capacitor $C_1$.

Figure 3:
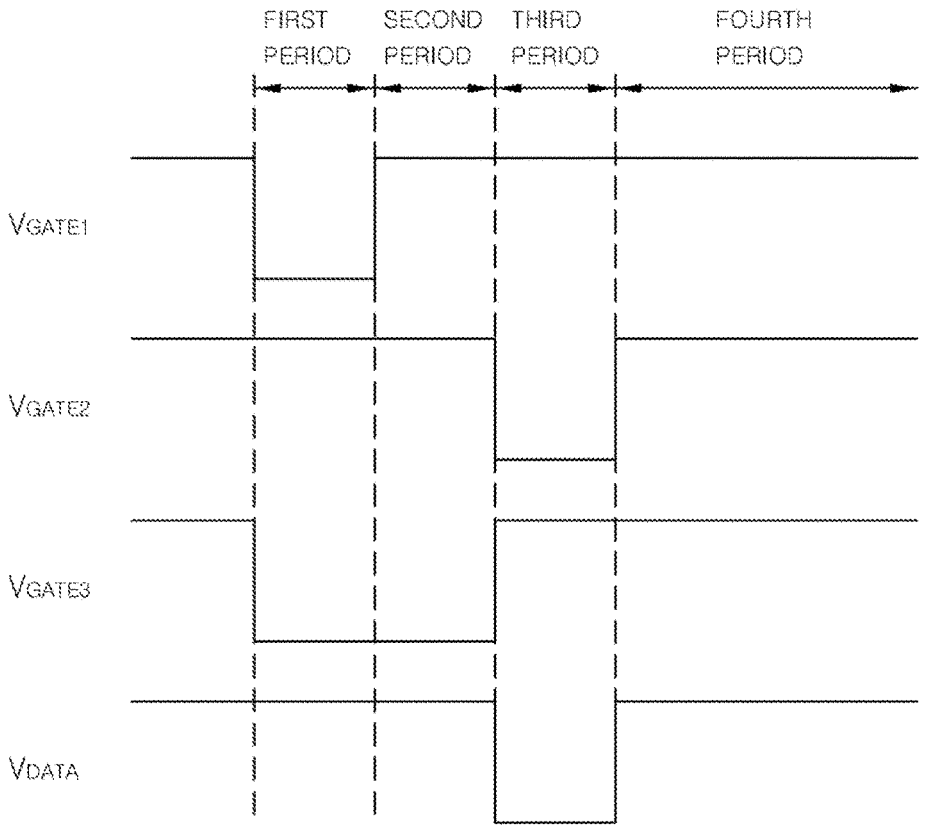
FIG. 3 is an operation timing diagram illustrating a gate signal and a data signal of a voltage compensation pixel circuit according to one embodiment of the present invention.

FIG. 3 is an operation timing diagram illustrating a gate signal and a data signal of a voltage compensation pixel circuit according to one embodiment of the present invention, and FIGS. 4*a*-4*d* are views conceptually illustrating an operation state of a voltage compensation pixel circuit according to the operation timing diagram of FIG. 3.

Figure 4A:
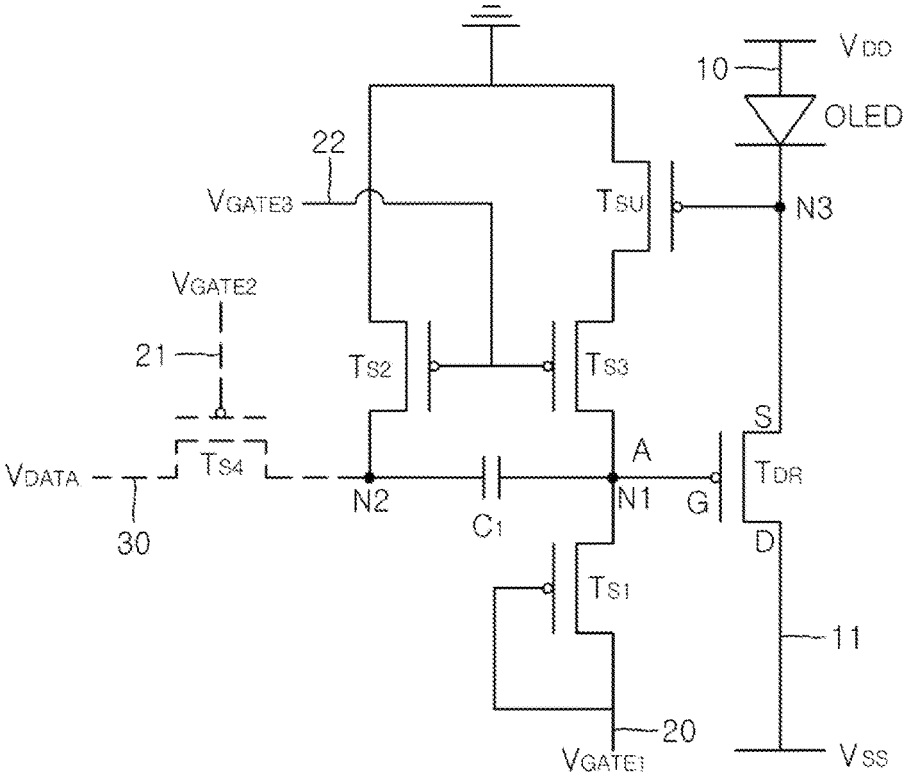
FIGS. 4*a* to 4*d* are views conceptually illustrating an operation state of a voltage compensation pixel circuit according to the operation timing diagram of FIG. 3.

Referring to a first period as shown in FIGS. 3 and 4A, the first switching TFT $T_{S1}$, the second switching TFT $T_{S2}$, and the third switching TFT $T_{S3}$ are turned on and a voltage is applied to the first node N1, and the driving TFT $T_{DR}$ is operated, and the light emitting unit OLED is operated. To this end, a gate-on-voltage $V_{ON}$ of a first gate signal is supplied to the first gate line 20, and a gate-on-voltage $V_{ON}$ of a third gate signal is supplied to the third gate line 22. Thus, referring to FIG. 4*a* the first switching TFT $T_{S1}$, the second switching TFT $T_{S2}$, and the third switching TFT $T_{S3}$ are turned on by the gate-on-voltages $V_{ON}$ of the first gate signal and the third gate signal. When the first switching TFT $T_{S1}$ and the second switching TFT $T_{S2}$ are turned on, a voltage is charged in the storage capacitor $C_1$ connected to the first node N1 by the first gate-on-voltage $V_{ON}$ of the first gate line 20. Here, the storage capacitor $C_1$ is charged by a voltage reduced from the first gate-on-voltage $V_{ON}$ by a threshold voltage of the first switching TFT $T_{S1}$. When the voltage is charged in the storage capacitor $C_1$, a voltage is applied to the gate electrode of the driving TFT $T_{DR}$ connected to the first node N1. When a voltage is applied to the gate electrode of the driving TFT $T_{DR}$, the driving TFT $T_{DR}$ is operated, and a current $I_{OLED}$ flows through the high potential power line 10 toward the low potential power line 11. When the current $I_{OLED}$ flows through the high potential power line 10 toward the low potential power line 11, a current flows through the light emitting unit OLED and emits light, and a voltage is applied to the gate electrode of the setup TFT $T_{SU}$, and the light emitting unit OLED is operated.

Figure 4B:
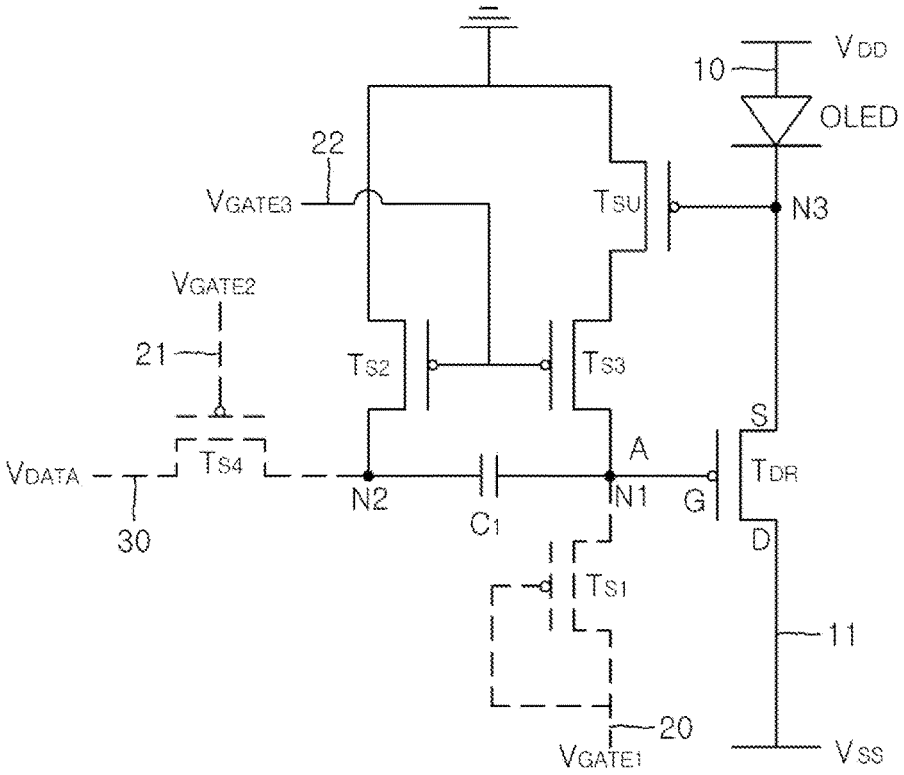

In a second period as shown in FIGS. 3 and 4*b*, the first switching TFT $T_{S1}$ is turned off, and the voltage charged in the storage capacitor $C_1$ is discharged through the second switching TFT $T_{S2}$ and the third switching TFT $T_{S3}$. To this end, the gate-on-voltage $V_{ON}$ of the first gate signal supplied through the first gate line 20 is converted into a gate-off-voltage $V_{OFF}$. Thus, referring to FIG. 4*b* the first switching TFT $T_{S1}$ is turned off, and the voltage charged through the storage capacitor $C_1$ is discharged to a ground potential through the second switching TFT $T_{S2}$, the third switching TFT $T_{S3}$, and the setup TFT $T_{SU}$. Here, the setup TFT $T_{SU}$ is discharged by a voltage reduced from a discharged base voltage by a critical voltage of the setup TFT $T_{SU}$.

Referring to the following Equation 1, a compensation voltage applied to the first node N1 during the second period is calculated.

$$V\text{comp}=V_{TH}(DR)+V_{TH}(SU)+\Delta V_{\mu}(Dr) \quad \text{Equation 1}$$

(wherein, Vcomp=a compensation voltage applied to a first node, $V_{TH}$(DR)=a critical voltage of a driving TFT, $V_{TH}$(SU)=a critical voltage of a setup TFT, $\Delta V_{\mu}$(Dr)=an electron mobility compensation voltage of a driving TFT)

The compensation voltage Vcomp applied to the first node during the second period equals a sum of the critical voltage $V_{TH(DR)}$ of the driving TFT $T_{DR}$, the electron mobility compensation voltage Vμ(Dr) of the driving TFT $T_{DR}$, and a voltage $V_{GS}$(DR) applied between the gate and source of the driving TFT $T_{DR}$.

Figure 4C:
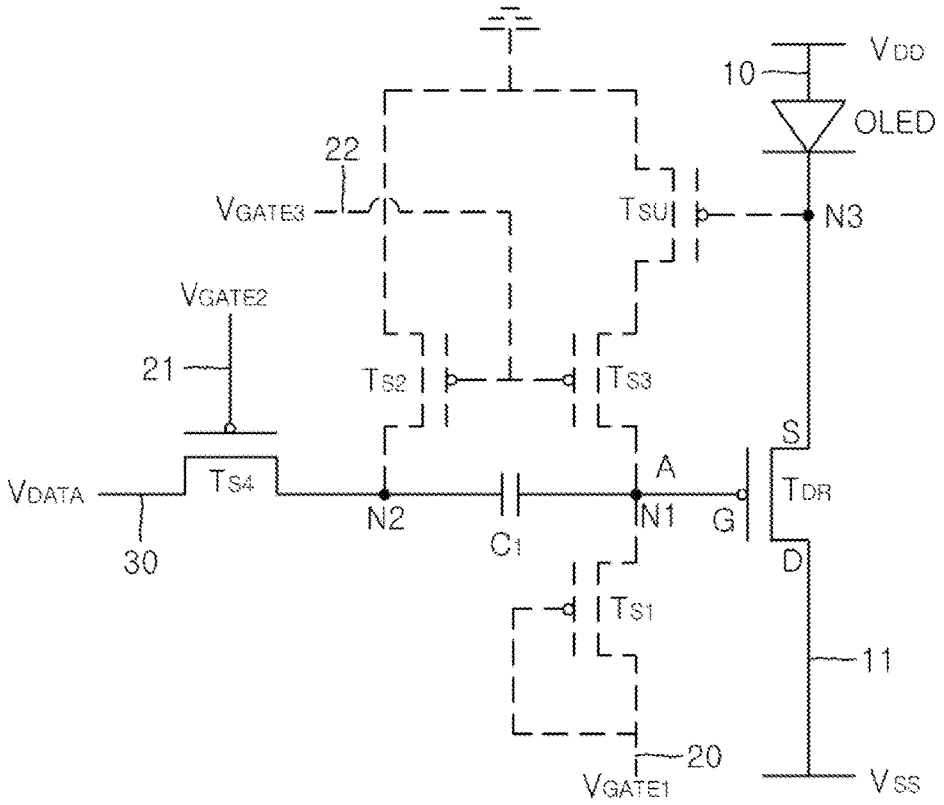

In a third period as shown in FIGS. 3 and 4*c*, the first switching TFT $T_{S1}$, the second switching TFT $T_{S2}$, and the third switching TFT $T_{S3}$ are turned off, and the fourth switching TFT $T_{S4}$ is turned on, and the data signal flows through the driving TFT $T_{DR}$. To this end, the gate-on-voltage $V_{ON}$ of the third gate signal supplied through the third gate line 22 is converted into a gate-off-voltage $V_{OFF}$, and the gate-on-voltage $V_{ON}$ of the second gate signal is supplied to the second gate line 21. Thus, referring to FIG. 3C, the second switching TFT $T_{S2}$ and the third switching TFT $T_{S3}$ are turned off, and the fourth switching TFT $T_{S4}$ is turned on.

When the second switching TFT $T_{S2}$ and the third switching TFT $T_{S3}$ are turned off, and the fourth switching TFT $T_{S4}$ is turned on, a voltage applied to the first node N1 equals a sum of a voltage of the data signal and the compensation voltage applied to the first node during the second period.

$$V_{N1}=V_{DATA}+V_{comp} \quad \text{Equation 2}$$

(wherein, $V_{N1}$=a voltage applied to the first node, $V_{DATA}$=a voltage of the data signal, $V_{comp}$=the compensation voltage applied to the first node)

Meanwhile, the voltage of the first node N1 shows a bootstrap effect due to an influence of the storage capacitor $C_1$.

Figure 4D:
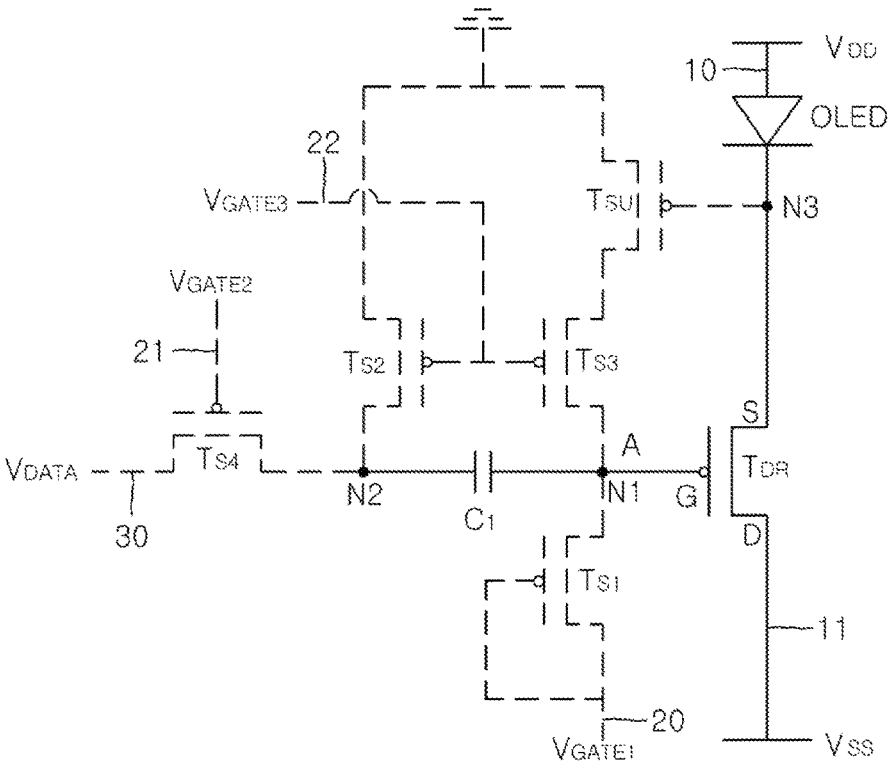

In a fourth period as shown in FIGS. 3 and 4*d*, supply of all of the gate signal and the data signal is stopped, and the operation of the switching TFTs $T_{S1}$, $T_{S2}$, $T_{S3}$, and $T_{S4}$ are stopped, and the driving TFT $T_{DR}$ is operated by the voltage stored in the storage capacitor $C_1$, and the current $I_{OLED}$ which flows through the light emitting unit OLED is shown in Equation 3.

$$I_{OLED}=\frac{k}{2}(V_{GS(DR)}-V_{TH(DR)})^2 \quad \text{Equation 3}$$

$$k=\mu\cdot\frac{W}{L}$$

(wherein, $I_{OLED}$=a current flowing through the light emitting unit OLED, $V_{GS(DR)}$=a voltage between the gate and source of the driving TFT, $V_{TH(DR)}$=a critical voltage of the driving TFT, $V_{GS(DR)}$=a voltage applied between the gate and source of the driving TFT, k=a constant, μ=electron mobility of the driving TFT, W=a width of the driving TFT, and L=a length of the driving TFT)

$V_{GS(DR)}$ in the fourth period is shown in Equation 4. Supply of all of the gate signal and the data signal is stopped, and the operation of the switching TFTs $T_{S1}$, $T_{S2}$, $T_{S3}$, and $T_{S4}$ is stopped, and thus, a voltage applied to the first node N1 in the previous period equals $V_{TH}$(DR).

$$V_{GS(DR)}=V_{DATA}+V_{comp} \quad \text{Equation 4}$$

Here, when the Equation 1 is combined with the Equation 4, Equation 5 may be derived.

$$I_{OLED}=\frac{k}{2}(V_{DATA}+V_{TH(DR)}+V_{TH(SU)}+\Delta V_{\mu(DR)}-V_{TH(DR)})^2 \quad \text{Equation 5}$$

In Equation 5, it may be understood that $V_{TH(DR)}$ is cancelled out. Referring to Equation 5, $V_{TH(DR)}$ is cancelled out, and the current $I_{OLED}$ which flows through the light emitting unit OLED is not affected by the critical voltage of the driving TFT $T_{DR}$.

$$I_{OLED}\propto\frac{k}{2}(V_{DATA}+\Delta V_{\mu(DR)})^2 \quad \text{Equation 6}$$

Referring to the Equation 6, it is understood that the effect of the critical voltage of the driving TFT $T_{DR}$ is cancelled out in the current $I_{OLED}$ which flows through the light emitting unit OLED, and the electron mobility compensation voltage $V_{\mu(DR)}$ of the driving TFT $T_{DR}$ is generated, and thus, the difference of the electron mobility in the current $I_{OLED}$ which flows through the light emitting unit OLED is compensated for.

In this specification, exemplary embodiments of the present invention have been classified into the first, second and third exemplary embodiments and described for conciseness. However, respective steps or functions of an exemplary embodiment may be combined with those of another exemplary embodiment to implement still another exemplary embodiment of the present invention.

The invention claimed is:

1. A voltage compensation pixel circuit of an organic light emitting display device for driving a light emitting element, the voltage compensation pixel circuit comprising:

a driving transistor coupled to the light emitting element between a high potential power line and a low potential power line to drive the light emitting element in response to a predetermined voltage applied to a gate;

switching transistor comprising, a first switching transistor being switched in response to a voltage of a first gate signal, a second switching transistor and a third switching transistor being switched in response to a voltage of a third gate signal, and a fourth switching transistor being switched in response to a voltage of a second gate signal;

a storage capacitor coupled between a first node and a second node, wherein the first node is coupled to the driving transistor, wherein the second node is coupled between the second switching transistor and the fourth switching transistor, and wherein the storage capacitor supplies a charged voltage to the driving transistor; and a setup transistor coupled between the light emitting element and the driving transistor and operated by the driving transistor, wherein the first switching transistor is turned on in response to the voltage of the first gate signal, and the second switching transistor and the third switching transistor are turned on in response to the voltage of the third gate signal, and a predetermined voltage is charged in the storage capacitor, and wherein the first switching transistor is turned off in response to the voltage of the first gate signal, and the voltage charged in the storage capacitor is discharged through the second switching transistor, the third switching transistor, and the setup transistor.

2. The voltage compensation pixel circuit of claim 1, wherein when the predetermined voltage is charged in the storage capacitor, the predetermined voltage is applied to the gate of the driving transistor coupled to the storage capacitor, a current flows from the high potential power line to the low potential power line, and the light emitting element is operated by the current.

3. The voltage compensation pixel circuit of claim 1, wherein a compensation voltage is generated at the first node when the voltage charged in the storage capacitor is discharged, wherein the compensation voltage is a sum of a critical voltage of the driving transistor, a critical voltage of the setup transistor, and an electron mobility compensation voltage of the driving transistor.

4. The voltage compensation pixel circuit of claim 1, wherein the first switching transistor, the second switching transistor, and the third switching transistor are turned off, the fourth switching transistor is turned on, and a data signal is supplied to the driving transistor.

5. The voltage compensation pixel circuit of claim 4, wherein when the first switching transistor, the second switching transistor, and the third switching transistor are turned off, the fourth switching transistor is turned on, and the data signal is supplied to the driving transistor, a voltage at the first node is a sum of a voltage of the data signal and a compensation voltage at the first node.

6. The voltage compensation pixel circuit of claim 5, wherein the voltage at the first node is a sum of the voltage of the data signal and the compensation voltage at the first node, and when the fourth switching transistor is turned off, a current flowing through the light emitting element by the voltage stored in the storage capacitor is determined by a critical voltage of the driving transistor and a voltage between the gate and a source of the driving transistor.

7. A method of driving a voltage compensation pixel circuit including a light emitting element, a driving transistor driving the light emitting element, a plurality of switching transistors being switched in response to a voltage of a gate signal, a storage capacitor coupled to the driving transistor and supplying a charged voltage to the driving transistor, and a setup transistor coupled between the light emitting element and the driving transistor and operated by the driving transistor, the method comprising:

individually operating the plurality of switching transistors in response to the voltage of the gate signal and charging a compensation voltage in the storage capacitor; and turning off all of the plurality of switching transistors in order to compensate for a change of a critical voltage of the driving transistor, and flowing a current proportional to a sum of a voltage of a data signal and an electron mobility compensation voltage of the driving transistor through the light emitting element, wherein the individually operating comprises turning on a first switching transistor, a second switching transistor, and a third switching transistor of the plurality of switching transistors and charging a predetermined voltage in the storage capacitor, wherein the individually operating comprises discharging the voltage charged in the storage capacitor through the second switching transistor, the third switching transistor, and the setup transistor when the predetermined voltage is charged in the storage capacitor and the first switching transistor is turned off and wherein a compensation voltage is generated when the voltage charged in the storage capacitor is discharged through the second switching transistor, the third switching transistor, and the setup transistor, and wherein the compensation voltage equals to a sum of a critical voltage of the driving transistor, a critical voltage of the setup transistor, and an electron mobility compensation voltage of the driving transistor.

8. The method of claim 7, further comprising turning off the first switching transistor, the second switching transistor, and the third switching transistor, turning on a fourth switching transistor, and adding a voltage of the data signal to the compensation voltage and supplying to the driving transistor.

9. The method of claim 8, further comprising turning off the fourth switching transistor, and operating the driving transistor by the voltage stored in the storage capacitor.

10. The method of claim 9, wherein the operating the driving transistor by the voltage stored in the storage capacitor comprises operating the driving transistor by a sum of the voltage of the data signal and the electron mobility compensation voltage of the driving transistor.

* * * * *